United States Patent [19]

Jones

[11] Patent Number: 4,654,909

[45] Date of Patent: Apr. 7, 1987

[54] HAMMER WITH STABILIZER BAR

[76] Inventor: Richard Jones, 1902 Frenchman St., New Orleans, La. 70116

[21] Appl. No.: 811,764

[22] Filed: Dec. 20, 1985

[51] Int. Cl.[4] ..... B25D 1/04

[52] U.S. Cl. ..... 7/143; 81/20; 81/489

[58] Field of Search ..... 81/20, 44, 124.3, 124.7, 81/177.5, 466, 489, 492; 7/143, 144, 140; 254/26 R, 26 E

[56] References Cited

U.S. PATENT DOCUMENTS

| | | | |
|---|---|---|---|
| 27,861 | 11/1867 | Hooker | 254/26 R |
| 356,925 | 2/1887 | Chamberlin | 81/20 |
| 418,085 | 12/1889 | Tack | 7/143 |
| 2,087,148 | 7/1937 | Hempy | 7/143 |
| 4,216,808 | 8/1980 | Royce | 254/26 R |

FOREIGN PATENT DOCUMENTS

| | | | |
|---|---|---|---|
| 345349 | 12/1921 | Fed. Rep. of Germany | 254/26 R |
| 8364 | of 1896 | United Kingdom | 254/26 R |

*Primary Examiner*—Frederick R. Schmidt
*Assistant Examiner*—Bradley I. Vaught
*Attorney, Agent, or Firm*—Llewellyn A. Proctor

[57] ABSTRACT

A hammer useful for driving tacks, or nails in normally inaccessible locations, or places. In brief, the new hammer can be characterized as including a central member having an arcuate lower face, and cross-members extended laterally outwardly from about the mid portion thereof to provide stability. An upper face of one terminal end of the central member provides a surface for directing a force against the head of a tack or nail to be driven, and the opposite terminal end of the central member provides a handle against which a force can be directed.

16 Claims, 5 Drawing Figures

HAMMER WITH STABILIZER BAR

BACKGROUND OF THE INVENTION

1. Field of the Invention

This invention relates to a hand tool, and in particular, to a novel hammer or tool useful, inter alia, for driving tacks, or nails (or for removing tacks, or nails). It relates moreover to a multi-purpose tool, but particularly to a hammer which can be used to hammer or drive tacks, or nails in normally inaccessible locations or places.

2. Background and Prior Art

Hand tools are devices used in manual work to help the hand fashion, measure and mark, or manipulate various objects. Chisels, screw drivers and hammers are illustrative of hand tools used by craftsmen to manipulate objects. Whereas hand tools were originated, and used by early man long before the iron age, their use and variety were increased with the introduction of steel, and much later by the introduction of machine-made hand tools.

Hammers appear among the oldest of hand tools used by carpenters, masons, and blacksmiths. Though of various sizes, and shapes, hammers can be characterized as including a head with a flat side, and handle by which it is gripped by the hand of the craftsman. It is now used predominantly to drive tacks, or nails, as to append or fasten one material, or object to another. Whereas hammers of such type have been used for countless years, there are serious limitations which severely limit, or restrict their use. The traditional hammer thus requires considerable space in that it must be raised by the hand of the craftsman to a modest height above an object to allow a tack, or nail, to be driven by blows directed and delivered by the flat face of the hammer against the head of the tack, or nail. Such space is obviously not always available and thus the use of a hammer for its intended purpose is often limited, or restricted.

The limitations of the conventional hammer can be illustrated, for example, by the typical door along the bottom edge of which one may desire to replace, or secure, a weather stripping. Thus, the typical door is of substantially rectangular shape and comprised of a rectangular frame. Such door is mounted in a door jamb by suspension of a side of the frame from a plurality of spaced-apart hinges comprised of hinge halves attached to the door frame and door jamb, pivotally attached one hinge half to another via hinge pins about which the door is pivotally attached. Objective: to attach a weather strip along the bottom edge of the door. Obviously, however, this cannot be done with the conventional hammer for there is barely room to place the weather stripping in place, and hold the nails, or tacks, in oriented position for driving in place. There is a complete lack of space for driving the nails, or tacks, by directed blows from a hammer. The weather strip can be placed on the bottom edge of the door only by the complete removal of the door from the frame which, after attachment of the weather strip, must be replaced upon the frame.

There is, as illustrated by this example, a need for a hand tool useful for driving tacks, or nails (or for removing tacks, or nails) from normally inaccessible locations, or places. In particular, there is a need for a tool, or hammer for use in the installation of weather stripping along the bottom edges of doors without any requirement of removing, and rehanging such doors as is normally necessary in the installation of weather stripping.

OBJECTS

It is, accordingly, a primary objective of this invention to supply these needs.

A specific object of this invention is to provide a hand tool, or novel hammer for driving tacks, or nails, in inaccessible places.

A further object is to provide a novel multi-purpose hand tool useful for functions in addition to that of driving (or removing) tacks, or nails.

SUMMARY OF THE INVENTION

These objects and others are achieved in accordance with the present invention, apparatus comprising a hammer the structural elements of which include an elongate center bar the bottom face of which is of arcuate shape, and a cross-bar, or second bar of elongate shape which is extended laterally outwardly from about the mid portion of said elongate center bar to provide stability. The arcuate bottom face of the center bar is designed to provide a shiftable fulcrum about which the elongate center bar can be rocked. One terminal end of the upper face of the elongate center bar provides a driving surface against which the head of a tack or nail can be rested, the opposite terminal end of the elongate center bar providing a handle against which a force can be directed to apply an equal and opposite force against the head of the tack, or nail.

These features and others will be better understood by reference to the following detailed description of the invention, and to the attached drawings to which reference is made. In the drawings, similar numbers are used to represent similar components in the different figures, and subscripts are used to designate a plurality of similar or analogous components.

REFERENCE TO THE DRAWINGS

Figure 1:
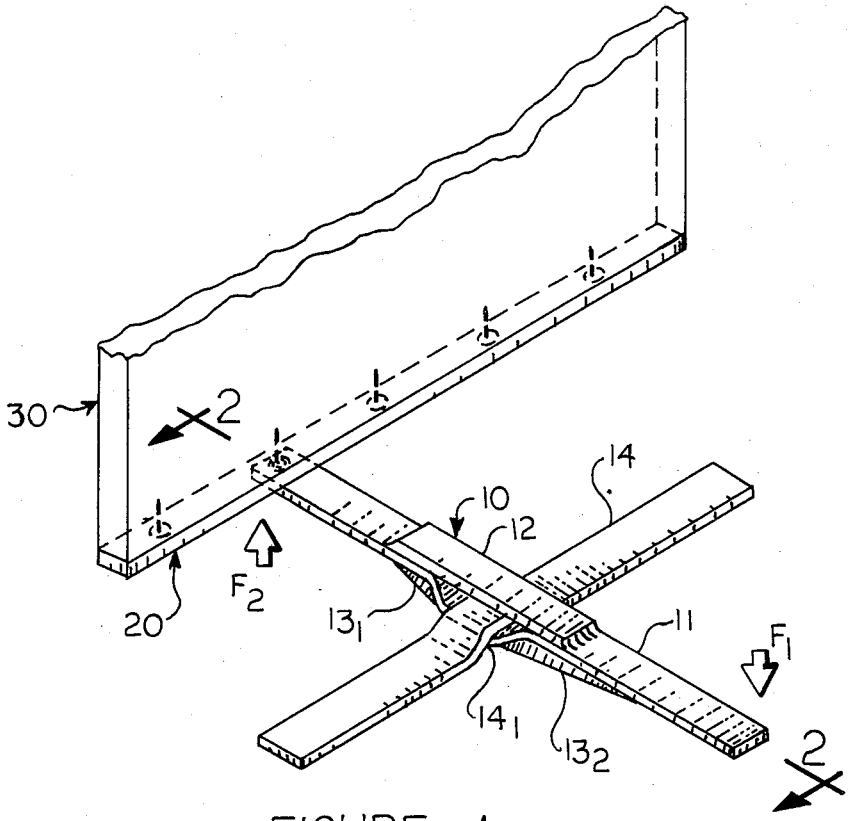
FIG. 1 depicts a preferred hammer of this invention, the hammer being shown in perspective positioned as it would be employed in attaching a weather stripping to the bottom edge of a door mounted on a door jamb.
Figure 2:
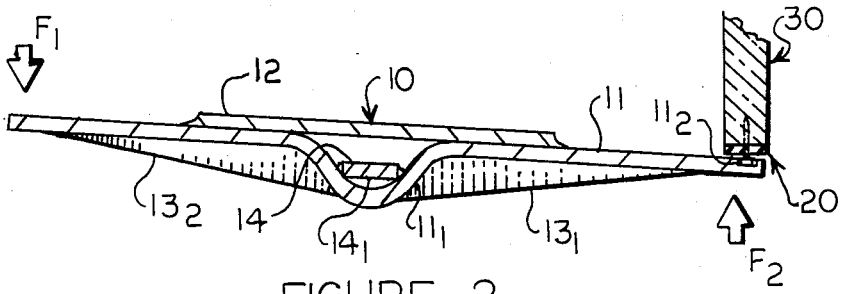
FIG. 2 is a sectional view taken through section 2—2 of FIG. 1.

Referring generally to FIGS. 1 and 2, particularly to FIG. 1, there is shown a preferred type of hammer 10 positioned as used for attaching a weather stripping 20 to the bottom edge of a wooden door 30. The wooden door 30 is hinged, or pivotally attached to a wood frame member (not shown) and swingable between open and closed positions with respect to a rectangular access opening (not shown) defined by said frame member.

The hammer 10 is constituted of an elongated center bar 11, the bottom face of which is arced via a deep notch, or U-shaped indentation $\mathbf{11}_1$ located at the approximate center of said bar. A short support bar, front stabilizer, or strut 12 is welded to the upper face of the center bar 11, the strut 12 lying across the U-shaped indentation to increase the mechanical strength of the structure. The bottom face of the elongated center bar 11 is also provided with an elongated bar 13, or elongated bar segments $13_1$, $13_2$, this bar also being added to increase the mechanical strength of the structure. The elongated bar 13, or each of elongated bar segments $13_1$, $13_2$, is attached via an upper elongate edge by welding same to the bottom face of the elongated center bar 11. The opposite, or bottom edge of the elongated bar 13, or the opposite or bottom edges of each of elongated bar segments $13_1$, $13_2$ are tapered from the U-shaped indentation toward a terminal end of the elongated center bar 11 to provide an overall arc effect so that the elongate center bar 11 can be rocked, or pivoted about the bottom of the U-shaped indentation $11_1$, which, in the use of the tool, acts as a fulcrum. The lateral stability, or balance of the elongated center bar 12 is maintained by an elongate bar 14 which is attached as by welding to the elongated center bar 11. The elongate bar 14 at about its center is provided with a notch, or U-shaped indentation $14_1$. The U-shaped indentation $14_1$ is meshed, and its bottom face attached to the upper face provided by the U-shaped indentation $11_1$ of the elongate center bar 11.

The upper face of the elongate center bar 11 of the hammer 10 is generally flat. An upper end of the elongate center bar 11 is provided with an indented surface, or indentation $11_2$ within which the head of a tack, or nail can be rested. In general, the indentation is constituted of a shallow hole with a flat base. With the tapered, pointed end of a nail or tack resting against a segment of the weather stripping 20 held by the hand in place along the bottom edge of a door 30, and with the head of the tack, or nail, resting within the indentation $11_2$, the shaft end of the nail or tack can be driven through the weather stripping 20 into the door. Thus, by application of a force $F_1$ upon the "handle end" of the hammer 10, i.e. an end of the center bar 11, an equal and opposite force $F_2$ is applied against the head of the tack or nail which drives the tack or nail upwardly (against gravity) through the weather stripping 20 into the door 30 to hold the weather stripping in place. By driving tacks, or nails, at spaced intervals along the length of a weather stripping 20, as depicted by reference to FIGS. 1 and 2, the weather stripping 20 can be attached to the bottom edge of the door 30 without removal of the door 30 from its hinges; a feat which cannot be accomplished by the use of a conventional hammer.

Figure 3:
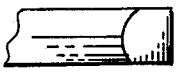
FIG. 3 is a segment defining a wood chisel portion of a multi-purpose tool fashioned from the hammer shown in FIGS. 1 and 2.

The same hammer 10 can be readily formed into a multi-purpose tool, or hand tool which can perform functions other than driving tacks, or nails. For example, a terminal end of the bar 14, or the handle end of the hammer tool, can be provided with a cutting edge such as commonly used in dressing, shaping or otherwise working wood, timber or even stone. Reference is thus made to FIG. 3 which depicts a terminal end of a bar, e.g. bar 14, shaped to provide a chisel.

Figure 4:
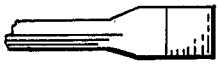
FIG. 4 is a segment defining a screw driver portion of a multi-purpose tool fashioned from the hammer shown in FIGS. 1 and 2.

Referring to FIG. 4, there is shown a terminal end of a bar, e.g. bar 14, shaped to provide a screw driver; a device commonly used to rotate or turn screws to drive same into a solid surface.

Figure 5:
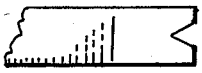
FIG. 5 is a segment defining a tack or nail puller, or retriever, fashioned upon the hammer shown in FIGS. 1 and 2.

Similarly, as depicted by reference to FIG. 5, a terminal end of a bar, e.g. bar 14, can be notched for use in pulling or retrieving tacks, or nails from a surface to which they were previously attached. Preferably, in manufacture of the hammer 10, the handle end of the tool, or terminal end of the center bar 11 opposite that containing the indentation $11_2$ can be notched to render the tool useful for retrieving tacks, or nails, as well as suitable for driving tacks, or nails. Likewise, the two terminal ends of the bar 14 of the tool can be shaped to provide a chisel as depicted by reference to FIG. 3, and a screwdriver as depicted by reference to FIG. 4.

Various modifications and changes can be made in the apparatus described without departing the spirit and scope of the invention. For example, the size, shape, and the material of construction can vary. The tool is preferably constructed of metal, or metals, suitably a ferrous metal, e.g. iron or steel. The tool can be constructed for use as a hammer, or as a hammer providing also the structure for pulling, or retrieving tacks, or nails. It can also be used for other purposes, e.g. as a crow bar, and may also be structured to provide additional functions.

Having described the invention what is claimed is:

1. Apparatus characterized as a hammer, udeful for driving tacks or nails in inaccessible places, which comprises a first elongate center bar containing a deep U-shaped indentation at approximately the mid portion therof, the open end of the U-shaped indentation facing upwardly to form a lower bottom face of arcuate shape providing a shiftable fulcrum about which said bar can be rocked, an upper face of one terminal end of said first elongate center bar providing a surface against which the head of a tack, or nail, can be rested, the other terminal end providing a handle, and a second elongate stabilizing bar oriented in a direction transverse to that of said first elongate center bar, a mid-potion of which is received within and contacting said U-shaped indentation thereof, the two ends of said second elongate stabilizing bar being of substantially equal length measured from the U-shaped indentation outwardly to a terminal end thereof, whereby, a tack or nail with its head resting against the upper face can be driven into an inaccessible location by downward force directed against the handle provided by said elongate center bar which applies an equal and oppositely directed force against the head of the tack or nail to drive same.

2. The apparatus of claim 1 wherein a strut is extended across the upper open side of said U-shaped indentation to provide structural strength.

3. The apparatus of claim 1 wherein a strut is extended across the upper open side of the U-shaped indentation to provide structural strength, and the bottom face of the elongate center bar is additionally provided with a third elongate bar, a long edge of which is attached to the bottom face of said first elongate center bar, said third elongate bar is tapered from the U-shaped indentation of said first elongate center bar to the terminal ends thereof to form an overall are effect so that said first elongate center bar can be rocked about the bottom of said U-shaped indentation.

4. The apparatus of claim 1 wherein the surface against which the head of a tack or nail can be rested is indented to facilitate receipt of the head of the tack or nail.

5. The apparatus of claim 1 wherein said other terminal end of said first elongate center bar is notched to provide a means for gripping the head of a tack or nail for retrieval after the tack or nail has been driven into a solid structure.

6. The apparatus of claim 1 wherein the terminal end of said first elongate center bar opposite that providing the surface against which the head of a tack or nail can be rested is notched to provide a means for gripping the head of a tack of nail for retrieval after the tack or nail has been driven into a solid surface.

7. The apparatus of claim 1 wherein one or both terminal ends of the second, elongate stablizing bar are shaped to provide a tool function additional to that provided by the hammer.

8. The apparatus of claim 1 wherein a terminal end of said second elongate stabilizing bar is shaped to provide a chisel function.

9. The apparatus of claim 1 wherein a terminal end of said second elongate stabilizing bar is shaped to provide a screwdriver function.

10. Apparatus characterized as a hammer, useful for driving tacks or nails in inaccessible places, which comprises an elongate center bar wherein a deep U-shaped indentation is located at approximately the mid portion thereof to form an arcuate lower face providing a shiftable fulcrum about which said bar can be rocked, an upper face of one terminal end of said center bar providing a surface against which the head of a tack, or nail, can be rested, the other terminal end providing a handle, a strut is extended across the upper open side of said U-shaped indentation to provide structural strength, and the bottom face of said elongate center bar is additionally provided with an elongate bar, a long edge of which is attached to the bottom face of said elongate center bar, the second bottom elongate bar is tapered from the U-shaped indentation of said elongate center bar to the terminal ends thereof to form an overall arc effect so that said elongate center bar can be rocked about the bottom of the U-shaped indentation, and a second elongate stabilizing bar the ends of which are projected laterally outwardly from the elongate center bar, whereby, a tack or nail with its head resting against the upper face can be driven into an inaccessible location by downward force directed against the handle provided by said elongate center bar which applies an equal and oppositely directed force against the head of the tack or nail to drive same.

11. The apparatus of claim 10 wherein the surface against which the head of a tack or nail can be rested is indented to facilitate receipt of the head of the tack or nail.

12. The apparatus of claim 10 wherein a terminal end of the elongate center bar is notched to provide a means for gripping the head of a tack or nail for retrieval after the tack or nail has been driven into a solid structure.

13. The apparatus of claim 10 wherein the terminal end of the elongate center bar opposite that providing the surface against which the head of a tack or nail can be rested is notched to provide a means for gripping the head of a tack or nail for retrieval after the tack or nail has been driven into a solid surface.

14. The apparatus of claim 10 wherein one or both terminal ends of the second, elongate stabilizing bar are shaped to provide a tool function additional to that provided by the hammer.

15. The apparatus of claim 10 wherein a terminal end of the second, elongate stabilizing bar is shaped to provide chisel function.

16. The apparatus of claim 10 wherein a terminal end of the second, elongate stabilizing bar is shaped to provide a screwdriver function.

* * * * *